US005259468A

United States Patent [19]

Warren et al.

[11] Patent Number: 5,259,468

[45] Date of Patent: * Nov. 9, 1993

[54] METHOD OF DYNAMICALLY MONITORING THE ORIENTATION OF A CURVED DRILLING ASSEMBLY AND APPARATUS

[75] Inventors: Tommy M. Warren, Coweta; Warren J. Winters, Tulsa, both of Okla.

[73] Assignee: Amoco Corporation, Chicago,, Ill.

[ * ] Notice: The portion of the term of this patent subsequent to Apr. 14, 2009 has been disclaimed.

[21] Appl. No.: 771,587

[22] Filed: Oct. 3, 1991

Related U.S. Application Data

[63] Continuation-in-part of Ser. No. 592,433, Oct. 4, 1990, Pat. No. 5,103,919.

[51] Int. Cl.[5] ..... E21B 7/06; E21B 21/08

[52] U.S. Cl. ..... 175/45; 175/48; 175/61

[58] Field of Search ..... 175/40, 45, 48, 61, 175/73, 74; 166/113; 367/83, 85

[56] References Cited

U.S. PATENT DOCUMENTS

| | | | |
|---|---|---|---|
| 2,142,559 | 1/1939 | Duus | 175/45 |
| 3,718,194 | 2/1973 | Hering et al. | 175/45 |
| 4,596,293 | 6/1986 | Wallussek et al. | 175/45 X |
| 4,699,224 | 10/1987 | Burton | 175/61 |
| 4,899,833 | 2/1990 | Warren et al. | 175/45 |
| 4,948,925 | 8/1990 | Winters et al. | 175/48 |
| 5,103,919 | 4/1992 | Warren et al. | 175/48 X |

*Primary Examiner*—David J. Bagnell

*Attorney, Agent, or Firm*—James A. Gabala; Richard A. Kretchmer; Frank J. Sroka

[57] ABSTRACT

Rotational orientation of a drillstring is monitored a plurality of times during each rotation of a drillstring for monitoring the rotational orientation of a curve drilling assembly on a drillstring. A defined rotational orientation of a downhole location on the drillstring with respect to the curve drilling assembly is established. At least one reference signal generator having a known relationship to the down hole location on the drillstring and that rotates with the drillstring is provided at the surface. A reference signal is generated each time a reference signal generator rotates past a detector. A pressure signal is generated each time the drillstring rotates through the defined rotational orientation with respect to the drill bit steering device. Occurrences of the plurality of surface reference signals and the pressure signal are timed and compared for monitoring the rotational orientation of the drill bit steering device.

15 Claims, 9 Drawing Sheets

METHOD OF DYNAMICALLY MONITORING THE ORIENTATION OF A CURVED DRILLING ASSEMBLY AND APPARATUS

This application is a Continuation in Part of application Ser. No. 592,433 filed Oct. 4, 1990 which has matured into U.S. Pat. No. 5,103,919.

The present invention relates to methods for rotationally orientating a downhole tool and, more particularly, but not by way of limitation, the invention relates to rotationally orienting such a downhole tool during directional drilling. The present invention further relates to methods for dynamically monitoring the rotational orientation of a downhole curve drilling assembly for drilling curved boreholes and, more particularly, to dynamically monitoring the rotational orientation of a reference location on the drillstring a plurality of times during each rotation of the drillstring.

In order to enhance the recovery of subterranean fluids, such as oil and gas, it is sometimes desirable to drill a borehole at an angle to a vertical borehole. For example, in an oil producing formation which has little vertical depth and relatively greater horizontal extent with respect to the surface of the earth, a borehole which extends horizontally through the oil producing formation can produce more oil than one extending vertically through the formation.

In order to directionally drill a borehole horizontally, or at any selected angle, it is necessary to be able to steer the rotating drill bit. Numerous devices have been patented for this task. U.S. Pat. No. 4,699,224 (Burton) discloses one such apparatus and method which uses a flexible drillstring connected by a flexible joint to a drill bit collar equipped with a stabilizer and rotary drilling bit. An eccentric cylindrical collar is connected circumferentially at the downhole end of the flexible drillstring over the flexible joint leading to the drill bit collar. The presence of the eccentric collar forces the drillstring to one side of the wellbore, thus lever arming the drill bit to the other side of the wellbore by virtue of pivoting on the stabilizer mounted to the drill bit collar between the flexible joint and the drill bit. Thus the drill bit's trajectory can be altered or steered.

A borehole engaging mechanism is mounted to the outside surface of the thicker wall of the eccentric collar and digs into the borehole wall to prevent clockwise rotation of the eccentric collar. When the drillstring is rotated clockwise, it rotates freely within the eccentric collar; but when it is rotated counterclockwise, a spring-biased latch mechanism latches the eccentric collar to the drillstring and causes the eccentric collar to rotate with the drillstring. This allows the eccentric collar to be rotationally reoriented with respect to the borehole.

Although the borehole engaging mechanism is designed to prevent the cylindrical eccentric collar from rotating with the drillstring during drilling, friction between the eccentric collar and the drillstring, together with downhole vibration and movement occurring during drilling, tend to rotate the collar; thereby resulting in the need to reorient the eccentric collar periodically.

U.S. Pat. No. 4,948,925 (Winters et al.), which is incorporated by reference, describes a signaling device that can be used with the apparatus disclosed in Burton '224 to generate a pressure pulse or signal whenever the drillstring is radially or rotationally oriented at a preselected point on a collar or deflection tool. The signaling device is used to indicate the orientation of the eccentric collar so that the borehole can be drilled in a desired direction. The initial orientation of a reference location near the lower end of the drillstring is established with a commercially available orientation technique, such as one using a mule shoe and either magnetic or gyroscopic surveying, as are well known in the art. The radial alignment of the mule shoe with respect to the radial alignment of the spring-biased latch mechanism on the drillstring is established at the time the drillstring is run into the borehole. After the survey is recorded, a reference location or mark can be established at the surface on the drillstring or rotary table to reference the position of the mule shoe and thus the latch mechanism. Since the rotational orientation of the collar recess with respect to the eccentricity is known, the rotational orientation of the eccentric collar with respect to the drillstring is known, and thus the reference location on the drillstring can be observed to indicate the direction that the bit is being steered.

After a period of drilling (clockwise rotation), drilling can be interrupted and the drillstring can be raised slightly and rotated counterclockwise to observe a pressure decrease when the orifice in the collar and the orifice in the drillstring are aligned, i.e., when the latch is radially coincident with the recess. Since the latch is then aligned with the recess in the eccentric collar, the orientation of the reference location at the surface can be interpreted to determine if the rotational orientation of the eccentric collar in the borehole has changed during the previous drilling period. Generally, the orientation is observed while rotating both clockwise and counterclockwise to account for twist in the drillstring.

Prior to the present invention, determination of the orientation of the collar required that drilling be interrupted every three to eight minutes. The interruptions are required to raise the drillstring, rotate the drillstring counterclockwise, observe the pressure pulse when the latch assembly opens, and determine whether the eccentric collar needs to be reoriented. These interruptions last for about three to eight minutes each and are unnecessary if it is found that no eccentric collar reorientation is needed. In some cases, the verification process itself may disturb the orientation of the eccentric collar. Additionally, if it found that the collar has moved, the amount of drilling that has occurred at unknown orientations and angles since the last verification of the proper positioning of the collar cannot be determined.

Winters et al. '925 discloses that the collar orienting apparatus may also serve as a collar orientation sensor. The point at which the valve opens and causes fluid pressure decrease during the orientation procedure is indicative of the collar position prior to readjustment. A clear indication of whether and to what extent the collar has moved during drilling is thus provided. The valve is in effect a form of measurement while drilling wherein the latch means functions as the sensor which detects collar orientation, the valve serves as a pulsor, and the pressure gauge or pressure sensor which senses fluid pressure in the conduit coupled with visual observation and interpretation of a reference mark on the drillstring at the surface provides a signal decoding function.

By this, the inventors of Winters et al. '925 meant that once drilling has been interrupted and the drillstring is raised slightly and rotated counterclockwise to allow the latch to engage the collar, the signal generated to indicate that the latch has engaged the collar, coupled with visual observation and interpretation of a reference mark on the drillstring, can be used to determine how far the drillstring must be rotated to return the collar to its original orientation.

While Winters et al. '925 provides an advantageous technique for monitoring the orientation of a downhole curve drilling assembly for drilling curved boreholes, it is desirable to provide a technique for monitoring the orientation of a downhole curve drilling assembly for drilling curved boreholes without periodically interrupting drilling, raising the drillstring, and rotating the drillstring counterclockwise.

The general object of the present invention is to provide a method for rotationally orientating a downhole tool on a conduit, such as a curve drilling assembly for drilling curved boreholes on a drillstring, during a process involving continuous rotation of the conduit, such as drilling. A more specific object of the present invention is to provide a method for dynamically monitoring the rotational orientation of a curve drilling assembly for drilling curved boreholes, such as an eccentric collar on a drillstring. Further objects of the present invention shall appear hereinafter.

The objects of the present invention can be obtained by a method for dynamically monitoring the rotational orientation of a downhole tool on a rotatable conduit comprising the steps: establishing an initial rotational orientation of a downhole tool with respect to a reference point on a rotatable conduit; generating a signal when the rotating conduit is in a defined rotational orientation with respect to the downhole tool during drilling; and monitoring the rotational orientation of the rotating conduit at which the signal occurs.

In somewhat greater detail, the objects of the present invention can be obtained by a method for dynamically monitoring the rotational orientation of a downhole tool on a rotatable conduit, comprising the steps: establishing an initial rotational orientation of a reference location on the downhole tool with respect to the conduit; flowing fluid, such as drilling mud, through the conduit; changing the size of the fluid flow path through the conduit when the conduit is in a defined rotational orientation with respect to the downhole tool; sensing the response of the flowing fluid to the change in size in the fluid flow path to generate a signal; providing at least one reference location on the conduit; generating a reference signal when the at least one reference location rotates past a detector; recording the signals generated, preferably, each time the rotating conduit rotates through the defined rotational orientation with respect to the downhole tool; and monitoring the angular displacement between the reference signals and the signal in order to monitor the rotational orientation of the downhole tool.

The method of the present invention requires generation of a signal (orientation signal or collar signal) to indicate when a downhole reference location (reference mark or reference point) on the rotating drillstring is in a defined orientation relative to the eccentric collar. A second signal, referred to as the reference signal (conduit signal or surface signal) is generated at least once per rotation of the drillstring, for determining the orientation of an uphole reference location that rotates with the drillstring with respect to a stationary reference at the time the orientation signal is generated. Knowing the initial relationship between the downhole and uphole reference locations, the orientation of the collar is monitored by monitoring the orientation of the uphole reference location when the orientation signal is generated.

The orientation signal is generated by causing a decrease in fluid pressure within the drillstring when the drillstring is in the defined orientation relative to the eccentric collar and detecting the fluid pressure decrease at the surface by a conventional fluid pressure detection means, such as a pressure gauge or pressure sensor.

The reference signal is generated by providing an uphole reference point, such as ferromagnetic material, and a signal detector, such as a magnetic detector, at a stationary location such that the reference point will rotate past the signal detector as the drillstring rotates. The reference point can be a single reference point or multiple reference points for generating multiple reference signals. Detection of multiple reference signals is desirable when the rotational speed of the drillstring is not constant.

The signal occurrences can be recorded by a conventional means, such as on chart paper, or can be detected by electronic equipment and recorded in computer memory.

By monitoring these signal occurrences, and thus the orientation of the collar, without interrupting rotation of the drillstring, interruption of drilling can be avoided until it is determined that the collar needs to be reoriented. If desired, an alarm system can be used to alert operators to changes in collar orientation beyond allowable limits and need for reorientation of the collar.

Essential elements of the present invention are the orientation signal, means for monitoring orientation of an uphole reference location that rotates with the drillstring, and means for accounting for twist in the drillstring. The azimuthal orientation of the uphole reference at the time of alignment of the orifices is determined, and twist in the drillstring is used for determining the orientation of the collar.

In one embodiment, the objects of the present invention can be attained by a method of dynamically monitoring the downhole rotational orientation of a curve drilling assembly on a rotatable drillstring, the method comprising the steps: generating a pressure signal when the drillstring is in a defined rotational orientation relative to the curve drilling assembly during drilling; generating at least one reference signal for monitoring the rotational orientation of the drillstring at which the pressure signal occurs; and comparing the pressure signal and the at least one reference signal for dynamically monitoring the rotational orientation of the curve drilling assembly.

The orientation signal is generated by changing the geometry of the fluid flow path through a conduit when the conduit is in the defined rotational orientation with respect to a downhole tool; flowing fluid through the conduit; and sensing the response of the flowing fluid to the change in geometry of the fluid flow path to generate the signal. More specifically, the orientation signal is generated by pumping fluid through the conduit; changing the size of the fluid flow path through the conduit when the conduit is in the defined rotational orientation with respect to the tool in order to create a pressure change in the flowing fluid and initiate signal; recording a pressure profile of the pumped fluid when the conduit is not rotating; recording a pressure profile of the pumped fluid when the conduit is rotating; and comparing the pressure profiles to generate the signals.

In one embodiment, the rotational orientation of the rotating conduit at which the orientation signal occurs is monitored by providing a reference point on the conduit; providing a stationary detector at a known orientation for a conduit reference point; determining the angular displacement of the reference point relative to the initial rotational orientation of the tool and conduit, at which orientation the orientation signal is generated; and monitoring the angular displacement as the conduit rotates in order to monitor the rotational orientation of the tool. More specifically, in this embodiment, a reference signal is generated preferably at least each time the reference point and conduit complete 360° of rotation; and the angular displacement between the reference signal and the signal is monitored in order to monitor the rotational orientation of the tool.

The present invention is better understood by reference to the following drawings.

Figure 4:
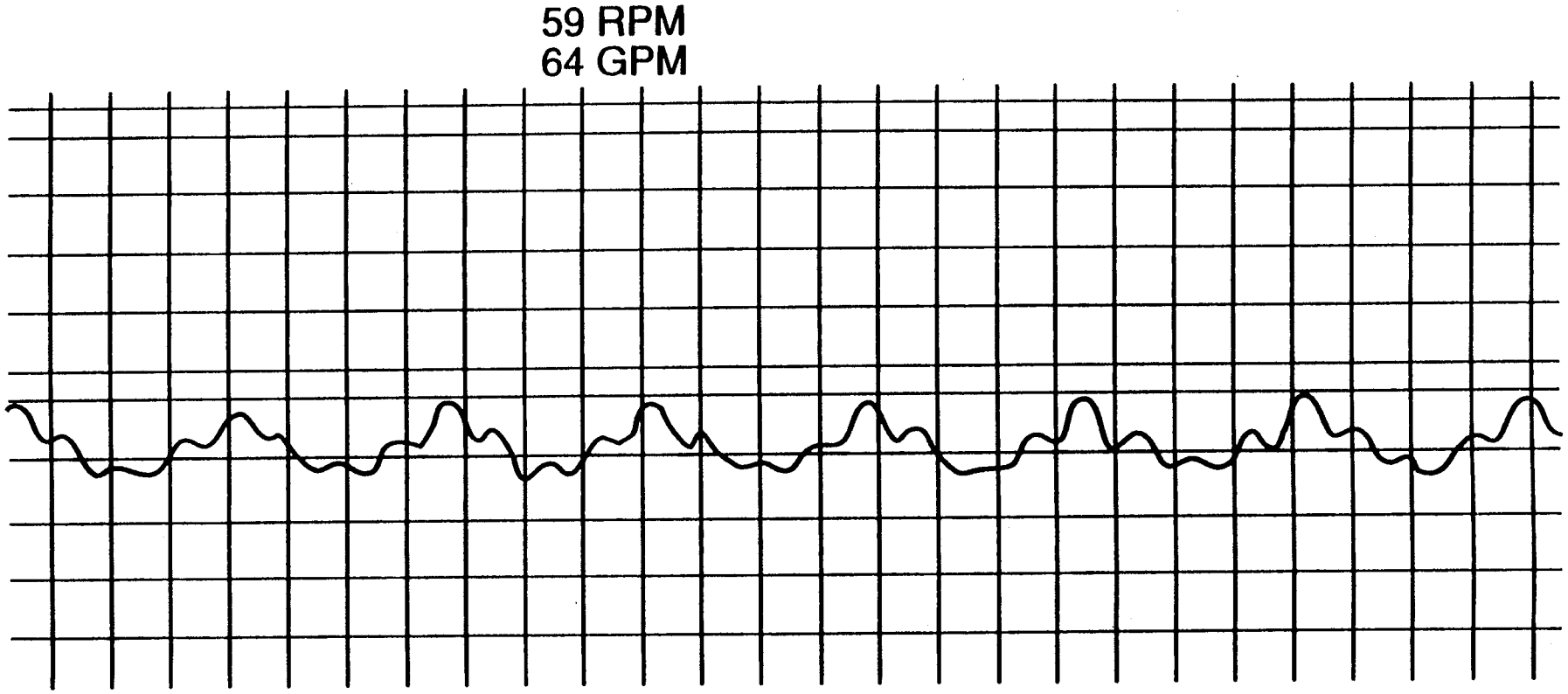

FIG. 4 plots pumped drilling fluid pressure versus time when the drillstring is rotating and when the drillstring includes an embodiment of a tool orienting apparatus utilized in the method of the present invention.

Figure 3:
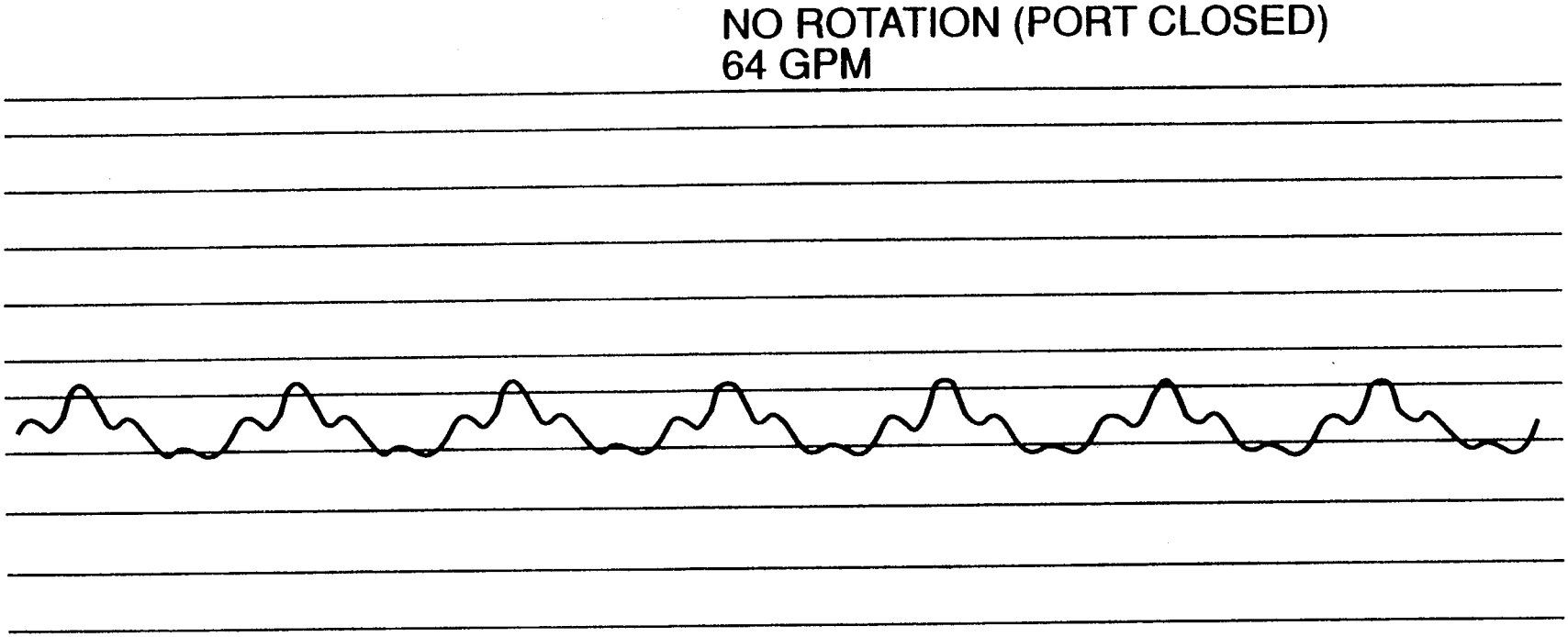
FIG. 3 is a plot of fluid pressure versus time, of drilling fluid being pumped through a drillstring when the drillstring is not rotating and the orifice in the drillstring and the orifice in the tool are not aligned.
Figure 5:
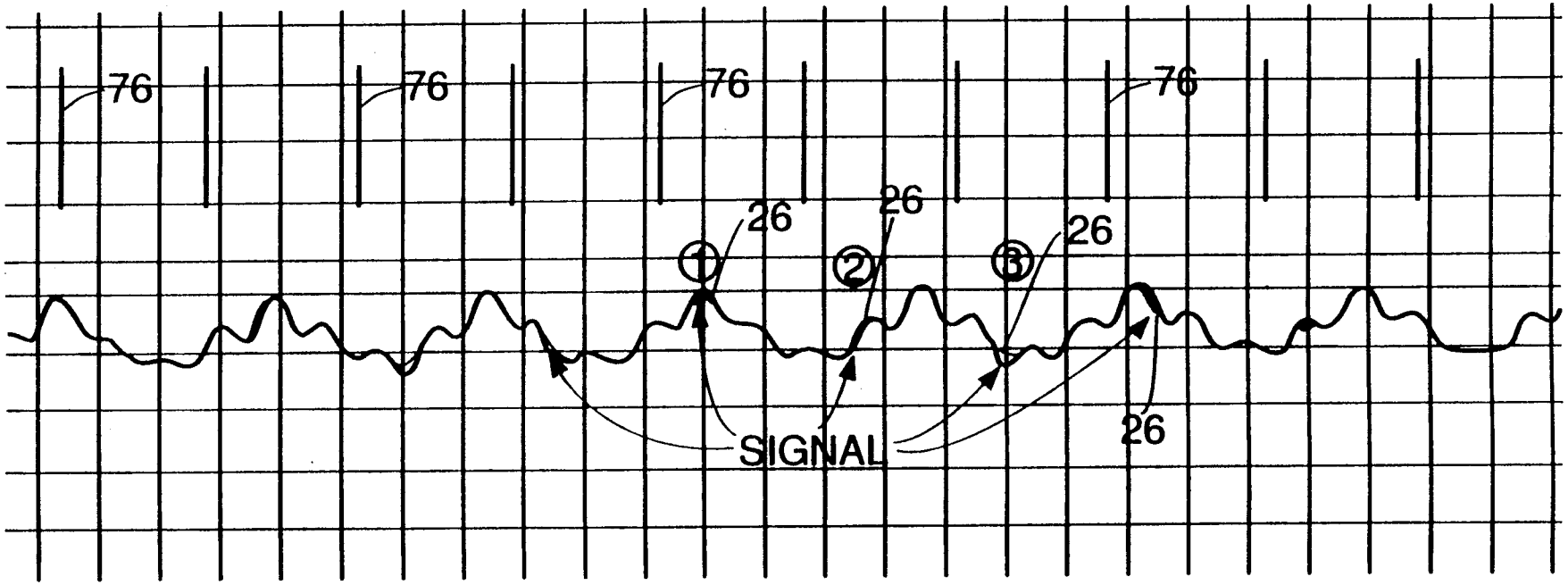

FIG. 5 is an overlay of FIG. 3 on FIG. 4.

Figure 6:
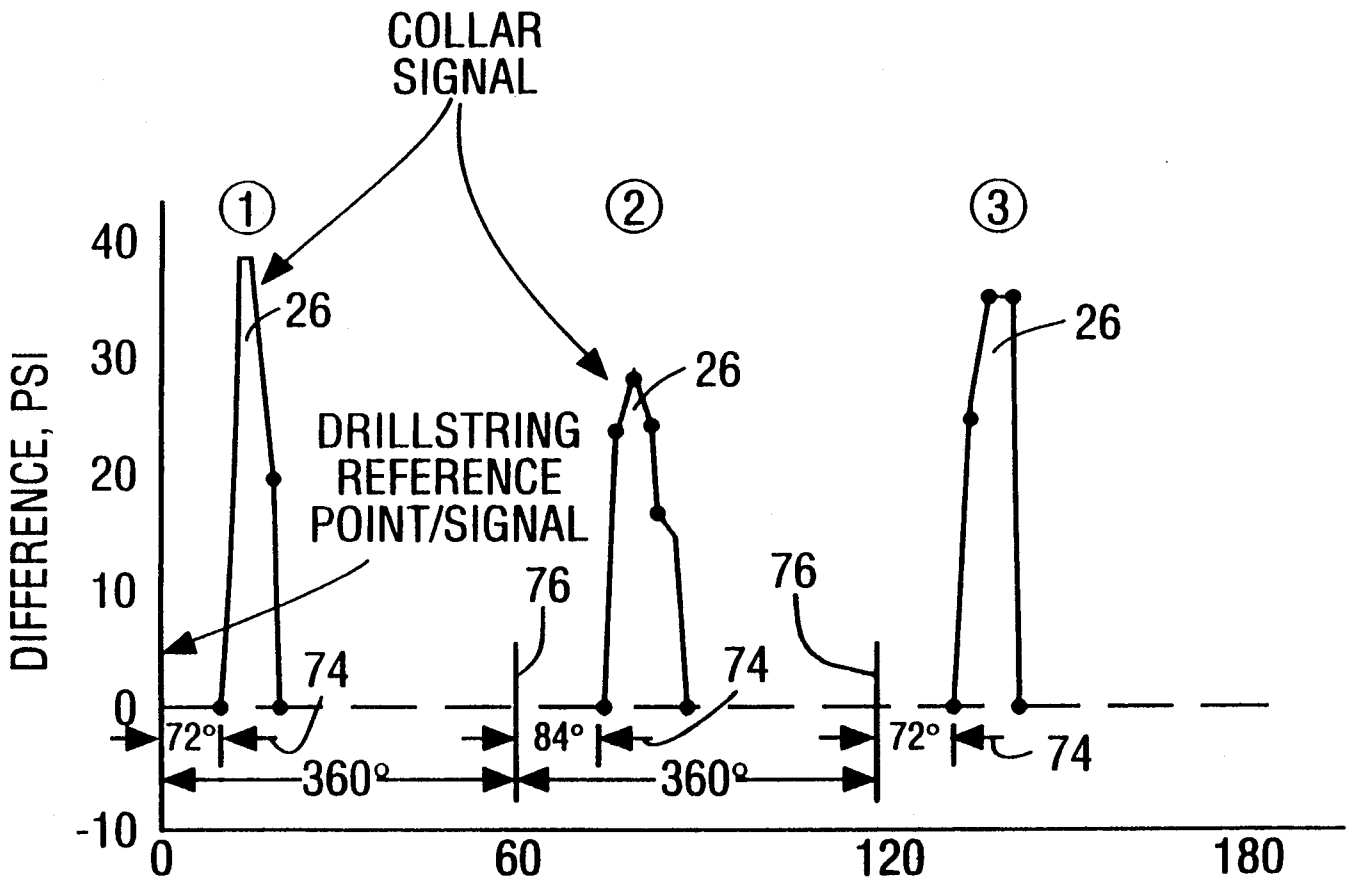

FIG. 6 illustrates an embodiment of the signal of the present invention obtained by subtracting FIG. 3 from FIG. 4.

Figure 7:
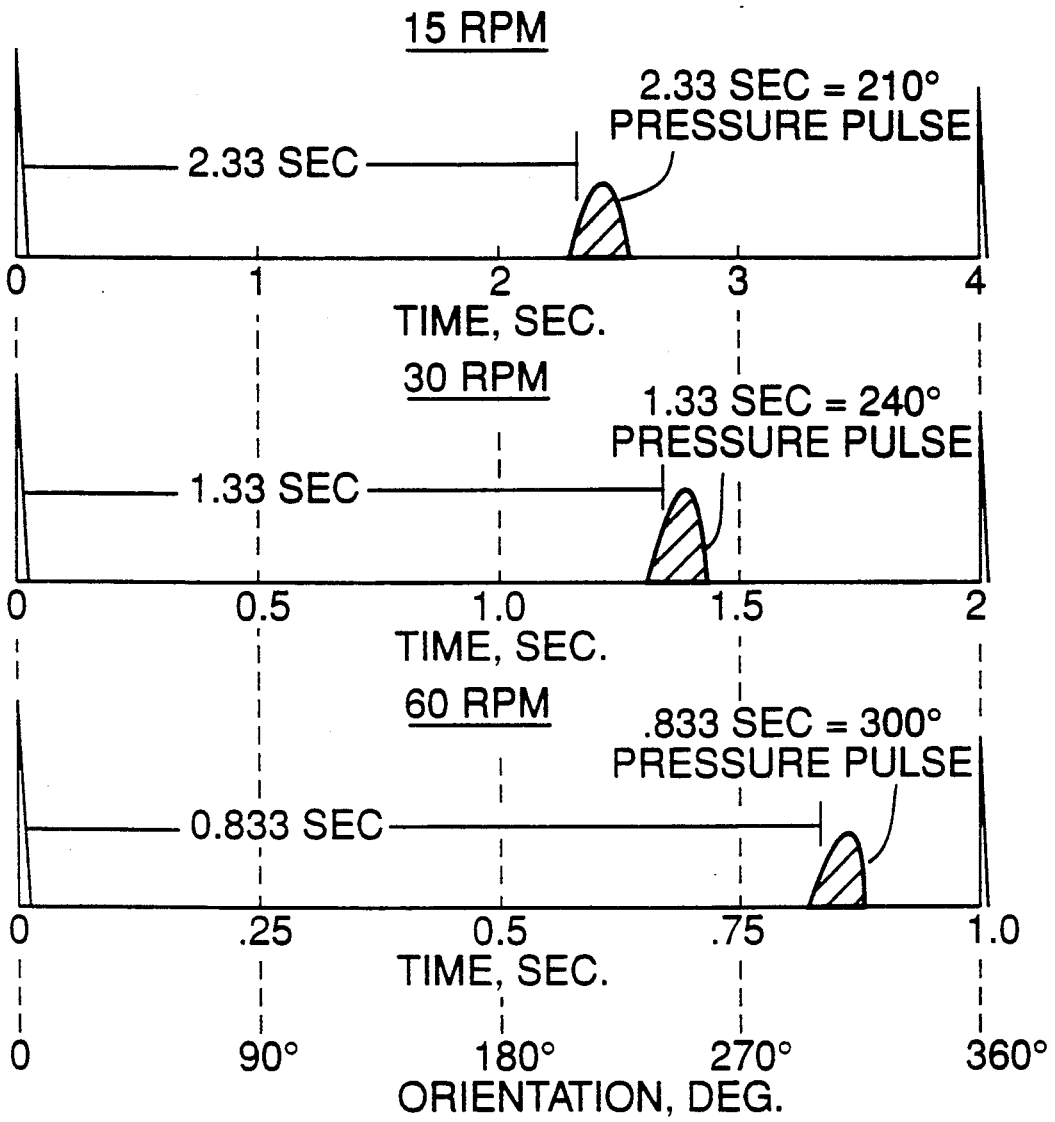

FIG. 7 is an illustration of the delay of the signal with respect to the rotary timing mark at rotational speeds of 15, 30, and 60 rpm.

Figure 8:
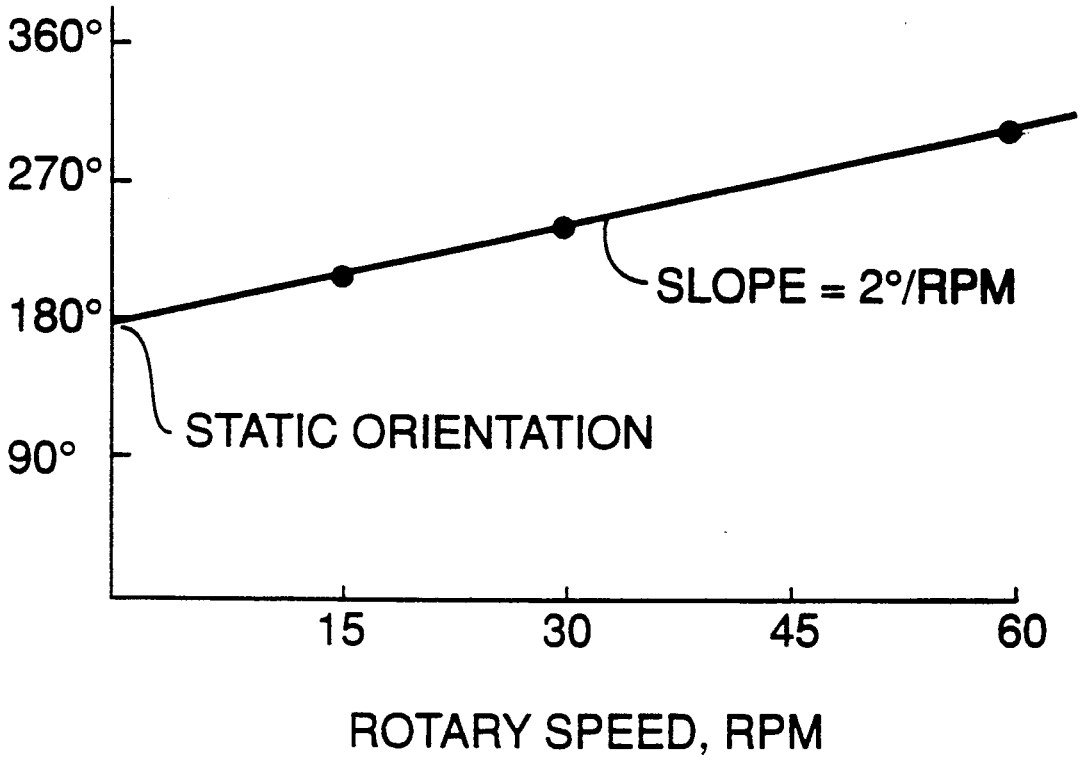

FIG. 8 is a plot of the angular position of the signal with respect to a reference point at rotational speeds of 15, 30, and 60 rpm.

Figure 9:
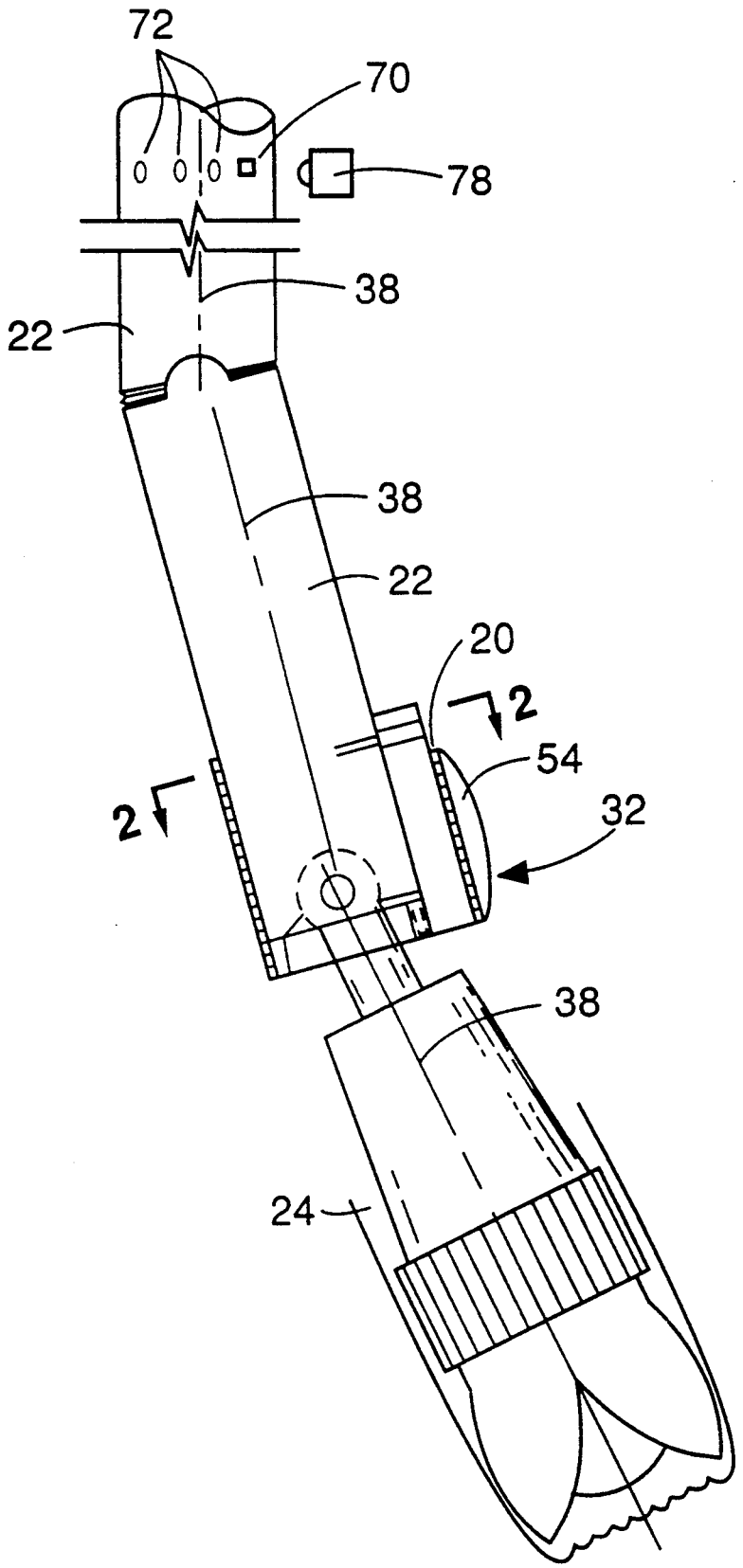

FIG. 9 is a partially sectioned side view of an embodiment of a downhole tool connected to a rotatable conduit utilized in the method of the present invention.

Briefly, the objects of the present invention can be attained by a method for dynamically monitoring the rotational orientation of a downhole tool on a rotatable conduit, comprising the steps: establishing an initial rotational orientation of a downhole tool with respect to a reference point on a rotatable conduit; rotating the conduit and generating a signal when the rotating conduit is in a defined rotational orientation with respect to the downhole tool; and monitoring the rotational orientation of the rotating conduit when the signal occurs.

In somewhat greater detail, the objects of the present invention can be attained by a method for dynamically monitoring the rotational orientation of a downhole tool on a rotatable conduit, comprising the steps: establishing an initial rotational orientation of a reference location on the downhole tool with respect to the conduit; flowing fluid through the conduit; changing the size of the fluid flow path through the conduit when the conduit is in a defined rotational orientation with respect to the downhole tool; sensing the response of the flowing fluid to the change in size in the fluid flow path to generate a signal; providing at least one reference location on the conduit; generating a reference signal when the at least one reference location rotates past the detector; recording the signal generated when the rotating conduit rotates through the defined rotational orientation with respect to the downhole tool; and monitoring the angular displacement between the reference signal and the signal in order to monitor the rotational orientation of the downhole tool.

Figure 1:
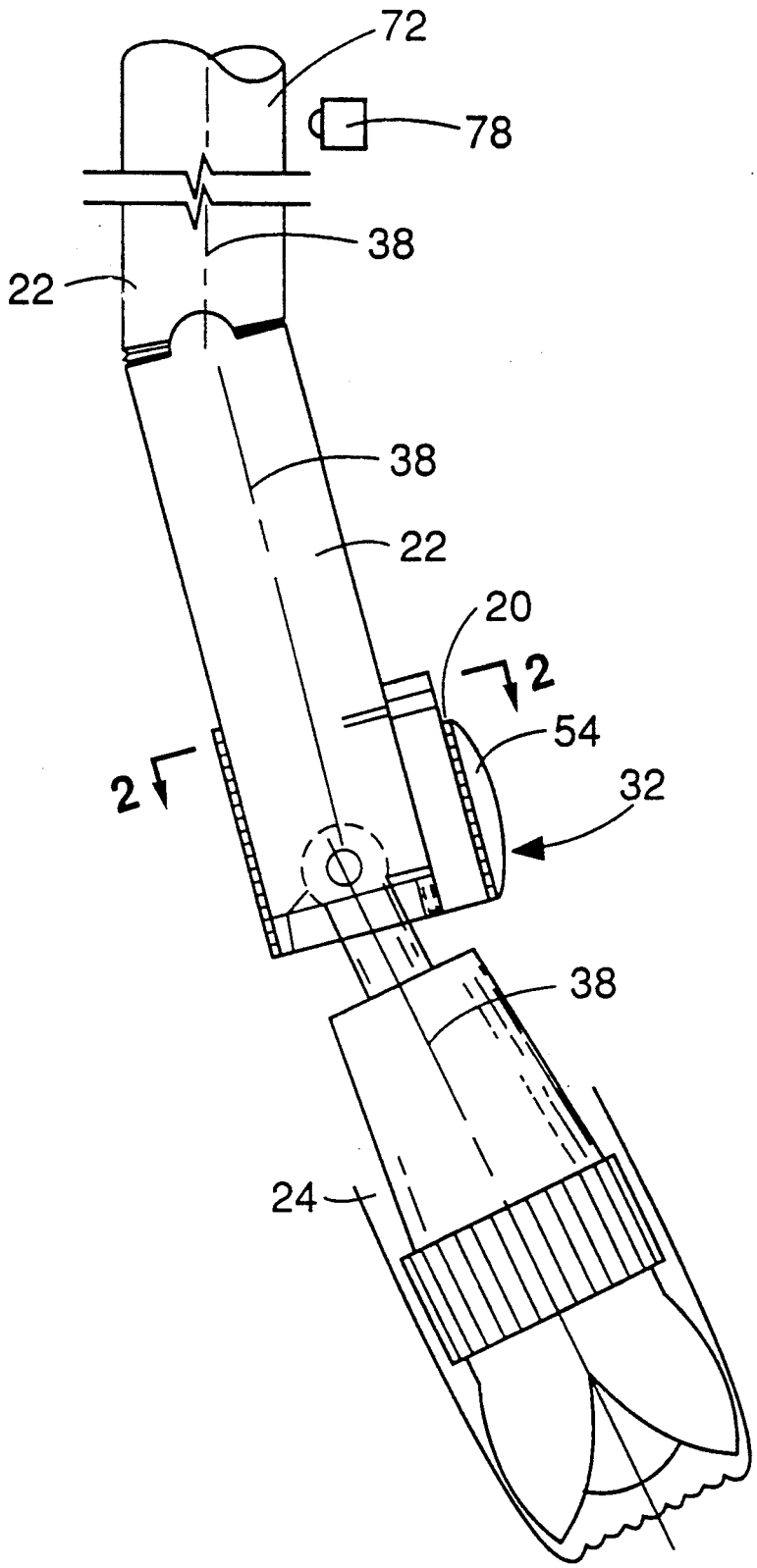
FIG. 1 is a partially sectioned side view of an embodiment of a downhole tool connected on a rotatable conduit utilized in the method of the present invention.
Figure 2:
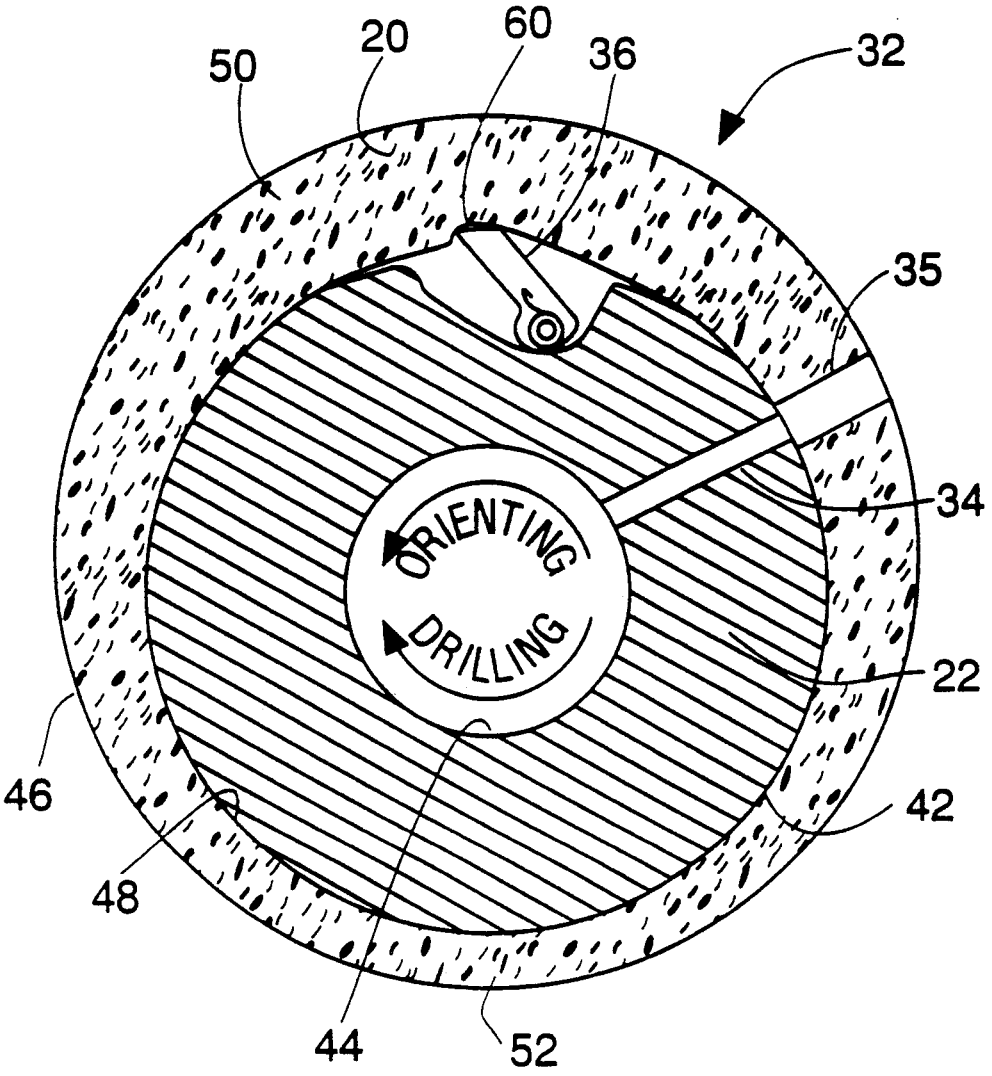
FIG. 2 is a view taken along line 2—2 of FIG. 1.

FIGS. 1-2 represent embodiments of downhole tools used in the method of determining the rotational orientation of a downhole tool 20 on a rotatable conduit 22, such as a drillstring 22. As exemplified in FIG. 1, in the preferred embodiment, the downhole tool 20, such as a collar, is connected to the drillstring 22 in the borehole 24 of an oil or gas well, although it is intended to be understood that the method can be used to rotationally orient virtually any type of tool or collar on any type of rotatable conduit in virtually any type of environment, e.g., water wells, steam wells, underwater conduits or pipes, surface installations of conduit, etc.

Referring to the example of FIG. 1, the method of the present invention can be generally described as including establishing the initial orientation of a conduit 22 reference location, having a defined rotational orientation relative to the collar 20, to a conduit 22 surface reference location; generating a signal 26 (best exemplified in FIGS. 5-6) when the conduit 22 is in the defined rotational orientation with respect to the collar 20; monitoring rotational orientation of the rotating conduit 22 at which the signal 26 occurs; and calculating the orientation of the collar 20 with respect to true north. By rotational orientation is meant the angular displacement of a surface reference location on the collar 20 or conduit 22 with respect to a reference point which does not rotate with the collar 20 or conduit 22, such as a reference point on the earth which is at a known direction with respect to true north.

In one embodiment, the signal 26 is generated by changing the size or structural characteristics of the fluid flow path through the conduit 22 when the conduit 22 is in the defined rotational orientation with respect to the collar 20 and sensing the response of the flowing fluid to the change in size or characteristics of the fluid flow path to generate the signal 26. The signal 26 can then be provided by sensing the changes in the flow or pressure of the fluid in the conduit 22. Commercially available flow or pressure sensing devices or transmitters (not illustrated) can be used to sense and transmit the flow or pressure changes, as is well known in the art. In this embodiment, the signal 26 is provided by changing the fluid pressure in the conduit 22 and, more specifically, is provided by decreasing the fluid pressure in the conduit 22 and sensing the fluid pressure decrease, as further discussed below.

In somewhat greater detail, referring to the example illustrated in FIG. 2, the signal 26 is created by providing an orifice 34 through the wall of the conduit 22, providing an orifice 35 through the collar 20, pumping fluids through the conduit 22 and discharging fluid through orifice 34 and orifice 35 when the conduit 22 is in a defined rotational orientation with respect to the collar 20 to create a pressure decrease in the flowing fluid and thereby to generate a signal.

The orifices 34 and 35 of the apparatus of the present invention are preferably configured to provide a signal 26 which is detectable at the surface. For example, the orifices can be round. When the orifice 34 through the wall of the conduit 22 is round, orifice 35 through the collar 20 can be an elongated slot for strengthening or increasing the duration of signal 26. In one embodiment, the orifices 34 and 35 are square for providing a sharper or more distinct signal.

In one embodiment, the signal 26 is generated using an orienting or signaling apparatus 32 which includes an orifice 34 through the wall of the conduit 22 and an orifice 35 through the wall of the collar 20. The collar 20 and conduit 22 are rotatable relative to one another about the longitudinal axis 38 of the conduit 22. The latch 36 is used for latching the collar 20 to the conduit 22, when orifices 34 and 35 are aligned, and rotating the collar 20 when the conduit 22 is rotated in the first direction ("orienting") about the longitudinal axis 38 of the conduit 22. Conversely, the latch 36 is used for unlatching the collar 20 from the conduit 22 and allowing the conduit 22 to rotate relative to the collar 20 when the conduit 22 is rotated in a second opposite direction ("drilling") about the longitudinal axis 38 of the conduit 22. For most purposes, the first "orienting" direction is counterclockwise and the second "drilling" direction is clockwise.

The collar orienting apparatus 32 is coaxially and rotatably mounted on the outside surface 42 of the conduit 22 with the fluid flowing within the inside surface 44 of the conduit 22. Further, the collar 20 has an outside surface 46 and an inside surface 48 with an eccentric collar, i.e., the collar 20 is a cylindrical sleeve with a cylindrical hole passing longitudinally therethrough with the axis of the hole being intentionally displaced to one side of the central axis of the collar 20. The resulting offset creates a relatively thick wall 50 on one side of the collar 20 and a relatively thin wall 52 on the other, opposite side of the collar 20. A borehole engaging mechanism 54 is mounted on the outside surface 46 of the thick wall 50 of the collar 20 and the latch 36 latches to the inside surface 48 of the thick wall 50 of the collar 20, opposite the borehole engaging mechanism.

Referring to the example illustrated in FIG. 2, the collar orienting apparatus 32 includes a recess 60 in the inside surface 48 of the collar 20. The recess 60 and the latch 36 are radially coincident with respect to the longitudinal axis of the conduit 22 at least once during each rotation of the conduit 22 relative to the collar 20. Being radially coincident means that the recess 60 and the latch 36 coincide on the same radius extending from the longitudinal axis 38. In one embodiment, the latch 36 and recess 60 also rotate in the same radial plane with respect to the longitudinal axis 38.

As exemplified in FIG. 2, the collar includes a sealing surface 48 for sealing orifice 34 when orifice 34 and orifice 35 are not radially coincident. In other words, when the conduit 22 is in the defined rotational orientation with respect to the collar 20, the latch 36 and recess 60 are radially coincident so that orifice 34 and orifice 35 are also radially coincident. When the latch 36 and recess 60 are not in the defined rotational orientation and not radially coincident, the inside surface 48 of the collar 20 effectively seals the orifice 34. The latch 36, orifice 34, orifice 35 and recess 60 are designed so that the orifice 34 and orifice 35 are aligned any time the conduit 22 is in the defined rotational orientation with respect to the collar 20, regardless of which direction the conduit 22 is rotating. Consequently, any time the conduit 22 rotates into or through the defined rotational orientation, the two aligned orifices 34 and 35 will allow fluid passage to create a pressure pulse or signal 26. Further description of various embodiments of the preferred collar orienting apparatus 32 and method can be found in Winters et al. '925, which has been incorporated by reference.

In one embodiment the signal is generated by pumping pressurized fluid through the conduit 22 and through the collar orienting apparatus 32; recording a pressure profile or pressure history (also known as a "pump signature") of the pumped fluid when the conduit 22 is not rotating, as is well known in the art, and as exemplified in FIG. 3; recording a pressure profile of the pumped fluid when the conduit is rotating, as exemplified in FIG. 4; and comparing the pressure profiles to generate the collar signal 26, as illustrated in FIGS. 5 and 6.

FIG. 3 is a recording of the fluid pressure versus time when the pump is operating and the drillstring is not rotating. FIG. 4 shows a recording of the fluid pressure in drillstring 22 versus time while drilling with the drillstring 22 rotating at 59 revolutions per minute (rpm). The predominant pressure variations on FIG. 4 are the pressure fluctuations caused by the cyclic motion of the plungers and valves in the pump used for the test.

FIGS. 3 and 4 appear to be very similar until the Figures are overlaid, as illustrated in FIG. 5, and the divergences identified. Since the divergences identify the signal 26, the divergences are indicated by reference number 26 on FIG. 5.

The pump profiles of FIGS. 3 and 4 can also be subtracted, as is well known in the art, to make the signal 26 more evident as exemplified in FIG. 6. The three collar signals 26 identified in FIG. 6 correspond to the signals 26 on FIG. 5. A pump timing signal, i.e., a signal generated at the same point in each cycle of the pump, can be used to facilitate placing the two pressure profiles in phase before they are subtracted. The detection of the signal 26 can be determined from a simple trigger level (magnitude of the difference in the two profiles) above the baseline difference or the difference signal can be differentiated to provide a more distinct inflection point for detection, i.e., to exaggerate the slope or rate of change and the difference between the pressure profiles. When a collar signal is detected, it can be integrated and compared to the integral of the expected collar signal in order to help identify faulty signals. This differentiation and integration of the signals are examples of well known techniques which can be used for identifying the signal 26 in its "noisy" environment. Other techniques for identifying the signal 26 are readily apparent in view of the disclosure contained herein.

If a computer is used to implement the method of the present invention, it may be desirable to record and average the fluid pressure over several cycles of the pump while the drillstring 22 is not rotating to obtain a more accurate pump signature. It may also be desirable to use the computer to proportionately expand or contract the measured pump profile (along either axis) in order to eliminate potential mismatches caused by slight variations in either the pump cycle and/or fluid pressure fluctuations in the drillstring 22.

Referring to FIG. 1, in one embodiment, the rotational orientation of the rotating conduit 22 at which the collar signal 26 occurs is monitored by providing a reference point 72 on the conduit 22; determining the angular displacement 74 (best seen in FIG. 6) of the reference point 72 relative to the initial rotational orientation of the collar 20 and conduit at which the signal 26 is generated; and monitoring or measuring the angular displacement of the reference point 72 relative to the initial rotational orientation of the collar 20 and conduit 22, i.e., monitoring the angular displacement of the reference point 72 with respect to the signal 26 as the conduit 22 rotates in order to monitor the rotational orientation of the collar 20.

More specifically, the rotational orientation of the rotating conduit 22 at which the signal 26 occurs is monitored by generating a reference signal 76 each time the reference point 72 and conduit 22 complete 360° of rotation; generating a signal 26 each time the rotating conduit 22 is in the defined rotational orientation with respect to the collar 20; and monitoring the angular displacement 74 between the reference signal 76 and the signal 26, as exemplified in FIG. 6, to monitor or measure the rotational orientation of the collar 20.

Referring to the example of FIG. 6, the time between reference signals 76 corresponds to 360° of rotation of the conduit 22 and a signal 26 should occur with every 360° of rotation; the time or angular displacement between the signal 26 and the reference signal 76 should remain the same unless the rotational orientation of the collar 20 with respect to the borehole 24 has changed. Therefore, the time between the reference signal 76 and the signal 26 can be used to calculate the angular displacement 74 of the eccentric collar 20 (since the position of the eccentric collar 20 relative to the recess 60 in collar 20 is known) relative to the reference point 72 and thereby to monitor any changes in the position of the eccentric collar 20 with respect to the borehole 24. These calculations are dependant on the assumption that the drillstring rotates at a constant rate. As explained below, this assumption does not always hold for drillstrings over 1,000 ft long and additional signals must be generated to account for same.

The operation of the method of dynamically monitoring the rotational orientation of a downhole tool on a rotatable conduit, such as an eccentric collar 20 on a drillstring 22 in a borehole 24, will now be described in more detail. First, an initial relationship between rotational orientation of the latch 36 and a reference point, such as the mule shoe sub, near the bottom of the drillstring 22 is established while tripping the drillstring 22 into the borehole.

If flexible collars having an asymmetrical cut are being used, this reference point is established with the flexible collars laid out horizontally and undergoing a clockwise torsional loading. A top mark is made at the top of each torsionally flexible section with a bubble level centering punch and a bottom mark is made at the bottom of each torsionally flexible section while applying a clockwise torque to the top of the section and holding the bottom stationary. The top mark and bottom mark are in line with the axis of the collar 20 when it is in the drilling configuration. When the curve assembly is tripped into the borehole, location of the top mark and the bottom mark are transferred across tool joints by measuring and recording the circumferential distance between the top mark on a lower torsionally flexible section and the bottom mark on an upper torsionally flexible section. A consistent sign convention is used when recording the measurements. The offset of all of the connections are summed in determining the initial offset between the latch 36 and the mule shoe sub.

The above method works well with flexible pipe having an asymmetrical cut because indications are that the punch marks remain in the same configuration when the pipe is positioned in the curved section of the borehole as when the pipe is laid out horizontally. However, when a flexible pipe have a symmetrical cut is used, present indications are that the punch marks do not remain in the same configuration when the pipe is positioned in the curved section of the borehole as when the pipe is laid out horizontally. An empirical relationship can be developed for determining the orientation of a top mark relative to a bottom mark once flexible pipe having a symmetrical cut is positioned in the curved section of the borehole. For example, the orientation of a top mark is observed to move 2°/ft clockwise, relative to bottom marks, when a particular flexible pipe is positioned in a 28-ft radius curve. Present indications are that use of a flexible pipe having a symmetrical cut rather than an asymmetrical cut provides a less noisy environment for identifying the signal 26.

After the drillstring 22 is tripped into the borehole, the drillstring is rotated with the bit off bottom a sufficient number of times, e.g., about six times, to allow the upper, torsionally inflexible portion of the drillstring to twist due to friction, as it will twist during drilling. Torque in the drillstring is measured at the surface. This torque is the tare or zero torque for torque measurements during drilling. A conventional technique such as magnetic or gyroscopic surveying is used to determine the orientation of the mule shoe sub while the drillstring is twisted. From the measured mule shoe orientation and the offset determined above, a reference mark 72 is located on the drillstring 22 to reference the orientation of the downhole latch. Normally, the reference mark 72 may be located on a portion of the drilling rig that rotates with the drillstring 22 but does not change elevational position with respect to the surface of the earth as does the drillstring 22. For example, on a rig operating with a kelly and a rotary table, the reference mark 72 is located on the rotary table. On a rig operating with a power swivel, the reference mark 72 is located on the rotating sub below the power swivel. A detector 78 is located at a stationary point near the surface reference mark 72 so that the detector 78 can generate a distinct surface reference signal 76 when the surface reference mark 72 rotates past the detector 78. The orientation of the detector 78 from the central line of the drillstring 22 relative to a selected azimuthal point, such as true north, is determined. In one embodiment, the surface reference mark 72 is a ferromagnetic material and the detector 78 is a magnetic detector.

Once the orientation of the collar latch 36 is established relative to the mule shoe sub, and the mule shoe sub orientation relative to the surface reference mark 72 is established, the drillstring 22 can be rotated counterclockwise to rotationally orient, i.e., to position the eccentric collar 20 as needed. As previously discussed, when the drillstring 22 is rotated counterclockwise the latch 36 engages recess 60 and rotates the collar 20 with the drillstring 22. Once the eccentric collar 20 is properly positioned, the drillstring 22 can be rotated clockwise to free the latch 36 from recess 60 and commence drilling. As previously discussed, a pressure signal 26 is generated each time the drillstring 22 rotates through the defined rotational orientation with respect to the collar 20, i.e., each time the latch 36 encounters recess 60, orifice 34 is aligned with orifice 35 and a pressure decrease is generated in the drilling fluid. The rotational orientation of the eccentric collar 20 is then monitored by timing and comparing the occurrences of reference signals 76 and the pressure signal 26. The orientation of the collar 20 with respect to true north is determined from its orientation relative to the reference mark 72 and the known azimuthal orientation of detector 78.

Since a finite time is required for the signal to travel from the collar 20 to the surface, the relative position of the surface reference mark must be adjusted to account for its clockwise rotation while the collar signal 26 is traveling from the collar 20 to the earth's surface. Similarly, an adjustment must be made for wind-up or twist in the drillstring due to changes in the torsional load on the bit. If the position, or rotational orientation, of the eccentric collar 20 changes in the borehole 24, such position will also change with respect to the initial orientation of the reference point 72 and reference signal 76. The signals can be recorded, as exemplified in FIGS. 4–6, to continuously monitor the rotational orientation of the eccentric collar 20 without interrupting rotation of the drillstring 22. Thus, it can be seen that the present method greatly improves drilling efficiency and borehole trajectory control by providing a more accurate knowledge of the rotational orientation of the eccentric collar 20 at all times.

The method can also be implemented using a computer to time and compare the occurrences of the reference signal 76 and the signal 26, and to automatically provide an update of the rotational orientation of the eccentric collar 20 with each revolution of the drillstring 22, or at any lesser frequency as desired. The computer is programmed to provide a continuously updated history of the rotational orientation of the eccentric collar 20. This history should be monitored so that drilling can continue uninterrupted until the rotational orientation of the eccentric collar 20 has changed sufficiently to require a repositioning of the eccentric collar 20.

The above-described orientation method is based upon determining the orientation of the drillstring at the surface when a signal arrives; knowing the travel time of the signal; and knowing the magnitude of twist, measured in degrees, in the drillstring. From these inputs, the downhole orientation of the tool at the time the signal was generated can be determined. The twist can be calculated from well known theoretical relationships, if the torque is known. The signal travel time can be calculated from the sonic velocity in the mud inside the drillstring 22. There are well-known theoretical relationships between the sonic velocity, drillstring geometry and mechanical properties, and the fluid properties. However, in some embodiments of the present invention, the drillstring 22 is composed of many different geometries (including a pliable hydraulic hose in wiggly drill collars) and the mud properties may not be exactly known, it would be better if the sonic velocity could be directly measured.

If the drillstring 22 is rotated at various speeds at the drilling depth, the arrival of the signal 26 will shift with respect to the surface orientation. For example, in FIG. 7 the arrival of the signal 26 is shown for three different rotational speeds at the drilling depth. The orientation of the eccentric collar 20 has not changed for each of these three measurements. At 15 rpm the signal 26 arrives 2.33 sec after the surface reference mark, at 30 rpm it arrives 1.33 sec after the surface mark, and at 60 rpm it arrives 0.83 sec after the surface reference mark. If this data is plotted as shown in FIG. 8, both the static orientation of the tool and the delay factor for the sonic travel time can be determined, by using well known techniques.

The twist can also be directly measured at the wellsite by monitoring the shift of the surface signal 26 as the torque changes. A linear relationship between twist and torque can be determined by applying weight to the bit and simultaneously measuring the signal shift and torque. This linear relationship can then be used to correct the measured signal arrival for twist while drilling.

Implementation of a correction procedure for signal delay can be accomplished by lowering the drillstring into the wellbore until the drill bit enters the top of the proposed curve; rotating the drillstring at several rotary speeds; recording the arrival of the signal at each rotary speed; calculating the best fit slope and intercept data for arrival time versus rotary speed using well known methods; and using the slope and any new measured rotational speed to adjust subsequent orientation signals for the sonic delay time, as shown in FIGS. 7 and 8.

Implementation of the correction procedure for drillstring twist can be accomplished by lowering the drillstring into the wellbore until the drill bit enters the top of the proposed curve; rotating the drillstring; applying weight to the drill bit of several different magnitudes; recording the arrival of the signal and the torque at each such weight; calculating the linear relationship between the torque and signal shift using well known methods; and using the linear slope and any new measured torque to adjust subsequent orientation signals for the drillstring twist, as shown in FIGS. 7 and 8.

As indicated above, the above-described embodiments of the method of the present invention are based on an assumption that the rotational speed of the drillstring is constant. This assumption does not materially affect the method during drilling at shallow depths, such as down to about 1000 ft. However, at depths or drillstring lengths greater than about 1000 ft, variations in both torque and rotational speed of the drillstring can affect the method. These variations or torsional resonance result from friction between torsionally flexible sections of drillstring and the borehole wall and between the drill bit and subterranean formation. When torque and rotational speed of the drillstring vary during a rotation of the drillstring, it is advantageous to have a method for monitoring the orientation of the drillstring a plurality of times during the rotation of the drillstring.

Referring to FIG. 9, in one embodiment of the present invention which is advantageous when the rotational speed of the drillstring is not constant, a plurality of reference signals 76 are generated by placing a plurality of surface references 72 around the circumference of the conduit 22. The plurality of reference signals 76 are generated when stationary detector 78 detects the plurality of surface references 72 as the conduit 22 rotates. The plurality of surface references 72 are uniformly spaced, for example, every 30° around the circumference of the conduit 22. Means is provided for distinguishing a selected reference signal 80 from the plurality of reference signals 76. For example, one surface reference 72 is located a wide distance from a selected surface reference 70, which references the orientation of the curve drilling assembly, relative to the spacing between the other surface references 72. Alternatively, the selected surface reference 70 is configured to provide a signal of a different magnitude than the other surface references 72 when detected by the stationary detector 78.

The plurality of reference signals 76 are used in monitoring the rotational orientation of the conduit 22. The stationary detector 78 detects the plurality of surface references 72 during each rotation of the conduit 22, generating the plurality of reference signals 76. The orientation of the detector is known; the angular displacement between the selected surface reference 70 and each of the surface references 72 is known; thus, the orientation of the selected surface reference 70 is directly measured when any reference signal 76 is generated.

A measurable time period elapses between alignment of the orifices and detection or arrival time of the pressure signal 26. In order to compare the pressure signal 26 to a surface reference signal 76 that was generated nearest to the time that the orifices were aligned, the time between orifice alignment and detection of the pressure signal 26 is subtracted from the detection time to determine the time at which the orifices were aligned.

Torque in the drillstring is measured directly for determining twist in the drillstring at the time of alignment of the orifices. For example, when a rig with a power swivel is utilized, torque is measured with a strain gauge load cell located in the power swivel torque arm of the rotary drilling rig. The time required for a torsional wave to travel from the drill bit to the surface is taken into account in determining the torque distributed in the drillstring at a given time. This time is determined from known theoretical relationships.

Knowing the rotational orientation of the drillstring 22 and the twist in the drillstring 22 at the time of alignment of the orifices and knowing the angular relationship between the selected surface reference and the latch 36, the rotational orientation of the collar 20 at the time of alignment of the orifices is determined.

In one embodiment of the present invention, the curve drilling assembly comprises a PDC anti-whirl bit, connected through a bit sub to a flexible joint. The flexible joint is connected through an eccentric collar on a rotatable mandrel to a flexible drillstring. The eccentric collar has borehole engaging means for preventing clockwise rotation of the collar during drilling. In this embodiment, the rotatable mandrel functions as a part of the drillstring.

In an example application of the method of the present invention, during drilling of a curved borehole in an oil-producing formation, at a rotational speed of about 50 rpm and at a depth of about 5,000 ft, the rotational orientation of a collar on a rotatable mandrel of a curve drilling assembly is dynamically monitored by comparing pressure signals initiated at the collar to reference signals at the surface.

During a three-second sampling interval, a pressure signal is detected at 2.2 seconds into the interval; subtraction of a signal delay time of 1.2 seconds from the detection time, indicates that orifices in the collar and mandrel were aligned at 1.0 second into the interval, causing a decrease in drilling fluid pressure; reference signal data indicates that the azimuthal orientation of a primary magnetic reference location was S 74° E at the time the orifices were aligned; a 736° twist in the drillstring is calculated for a measured torque of 1,000 ft-lbs at the time the orifices were aligned; therefore, the orientation of the collar at the time the orifices were aligned is determined to be due east, the same as its original orientation.

During a subsequent three-second sampling interval, a pressure signal is detected at 2.7 seconds into the interval; subtraction of the signal delay time of 1.2 seconds from the detection time, indicates that orifices in the collar and mandrel were aligned at 1.5 seconds into the interval, causing the decrease in drilling fluid pressure; reference signal data indicates that the azimuthal orientation of a primary magnetic reference location was S 64° E at the time the orifices were aligned; a 736° twist in the drillstring is calculated for a measured torque of 1,000 ft-lbs at the time the orifices were aligned; therefore, the orientation of the collar at the time the orifices were aligned is determined to be S 80° E.

Drilling is stopped and the drillstring and mandrel are rotated counterclockwise. After a pressure signal at the surface indicates that a latch in the mandrel has engaged the collar, the drillstring is rotated counterclockwise another 10° to reorient the collar to due east.

The oil-producing formation in this example extends from a depth of about 4,900 ft to a depth of about 5,100 ft and is penetrated by a vertical wellbore. A workover rig, with a power swivel, and a curve drilling assembly for drilling short radius lateral boreholes are provided for drilling a lateral drainhole into the formation.

Torque in the drillstring and mandrel is measured during drilling with a strain gauge load cell located in the power swivel torque arm of the rotary drilling rig. At 5,000 ft, a torsional wave travels from the drill bit to the surface in approximately ½ second. Thus the torque recorded for the next ½ second after alignment of the orifices is the torque distributed in the drillstring at the time the orifices were aligned.

Prior to tripping the drillstring and curve drilling assembly into the borehole, an angular relationship is established between a latch on the mandrel and a mule shoe orienting sub key. Once the drillstring and curve drilling assembly are tripped into the borehole, for initiating directional drilling at a depth of about 5,000 ft., the drillstring is rotated clockwise six times with the bit off bottom to set the tare torque. A magnetic survey tool is seated in the key of the mule shoe orienting tool for determining the orientation of the mule shoe key, and thus the latch on the curve drilling assembly mandrel. A primary magnetic reference is established at the surface on a rotating sub below the power swivel to reference the azimuthal orientation of the mule shoe key and thus the latch. The drillstring and mandrel are rotated counterclockwise for establishing the original orientation of the collar at due east. Orientation of the primary magnetic reference location is also at due east.

A signal generator at the collar is utilized for dynamically monitoring rotational orientation of the collar during drilling. Signal delay time is established by rotating the drillstring clockwise at speeds of 20, 30, 40, 50, 60, 70, and 80 rpm. When an orifice in the mandrel aligns with an orifice in the collar during each rotation of the mandrel, drilling fluid pumped through the drillstring and mandrel flows out through the orifices causing a fluid pressure decrease which is detected with a pressure gauge at the surface. The orientation of the primary magnetic reference, relative to its initial orientation of due east, is monitored at the time each fluid pressure decrease is detected. Reliability of the data is established by repeating the 20 rpm data point. Orientation of the primary magnetic reference at the time the pressure decrease is detected is plotted vs. drillstring rotational speed. The slope of a line fit to the data, 7.2 deg/rpm, is equivalent to a signal delay time of 1.2 sec at about 5,000 ft.

For generating the reference signals, the primary magnetic reference is established at the surface on the rotating sub below the power swivel at due east for referencing the orientation of the mule shoe key. Eleven smaller, secondary magnetic references are established on the rotating sub, with spacing of 30° between the magnetic references. A magnetic detector is located at a stationary location due east of the rotating sub for generating a distinct reference signal each time a magnetic reference rotates past it.

In another embodiment, the present invention is directed toward an improved signaling apparatus and method for use in determining the orientation of a drilling assembly for drilling curved boreholes. In this embodiment, the signal 26 is generated using an improved signaling apparatus 32 which includes an orifice 34 through the wall of the conduit 22 and an orifice 35 through the wall of the collar 20. The collar 20 and conduit 22 are rotatable relative to one another about the longitudinal axis 38 of the conduit 22. The orientation of the conduit 22 relative to the collar 20 when orifices 34 and 35 are aligned is related to a stationary reference, one that does not rotate with the drillstring, as described above. Whenever orifices 34 and 35 are aligned, during drilling or when drilling is interrupted, fluid flowing in the conduit 22 flows through the orifices 34 and 35, causing a fluid pressure decrease detectable at the surface. In this embodiment, the orifices 34 and 35 are configured to provide a distinct signal 26, which is detectable at the surface. When the orifice 34 in the conduit 22 is round, orifice 35 in the collar 20 can be an elongated slot for strengthening or increasing the duration of signal 26. When the orifice 34 is square, the orifice 35 is square for providing a sharper or more distinct signal.

While present embodiments of this invention are described herein for the purpose of disclosure, numerous changes in the construction and arrangement of parts and the performance of steps will suggest themselves in those skilled in the art, which changes are encompassed within the spirit of the invention as defined by the following claims.

What is claimed is:

1. A method for dynamically monitoring the rotational orientation of a downhole tool on a rotatable conduit, comprising the steps of:

(a) establishing an initial rotation orientation of a downhole tool with respect to a plurality of reference points on a rotatable conduit;

(b) generating a tool signal when the rotating conduit is in a defined rotational orientation with respect to the downhole tool during drilling; and (c) monitoring the rotational orientation of the rotating conduit at which said tool signal occurs by generating at least one reference signal each time said reference points and said conduit complete 360 degrees of rotation, generating a tool signal each time said rotating conduit is in said defined rotational orientation with respect to said downhole tool, and determining the angular displacement of said reference points relative to said initial rotational orientation of said downhole tool and rotatable conduit at which said tool signal is generated by measuring the angular displacement between said reference signals and said tool signals.

2. A method of claim 1 in which step (b) comprises:

flowing fluid through the rotating conduit;

changing the size of a fluid flow path through the rotating conduit when the rotating conduit is in the defined rotational orientation with respect to the downhole tool; and sensing the response of the flowing fluid to the change in size of the fluid flow path to generate the tool signal.

3. A method of claim 1 in which step (b) comprises:

pumping fluid through the conduit;

changing the size of the fluid flow path through the conduit when the conduit is in the defined rotational orientation with respect to the downhole tool in order to create a pressure change in the flowing fluid;

recording a pressure profile of the pumped fluid when the conduit is not rotating;

recording a pressure profile of the pumped fluid when the conduit is rotating; and comparing the pressure profiles.

4. The method of claim 1, further including the step of:

(d) stopping rotation of the conduit and reorienting the downhole tool when dynamic monitoring indicates that reorientation is necessary.

5. A method of dynamically monitoring the rotational orientation of a curve drilling assembly on a drillstring, comprising the steps:

(a) generating a pressure signal when a drillstring is in a defined rotational orientation relative to a cure drilling assembly during drilling;

(b) generating a plurality of reference signals for monitoring the rotational orientation of the drillstring at which the pressure signal occurs; and (c) comparing the times of occurrence of the pressure signal and the reference signals for dynamically monitoring the rotational orientation of the curve drilling assembly.

6. A method of claim 5 wherein the pressure signal is generated by:

providing a drillstring orifice through a wall of the drillstring;

providing an assembly orifice through a wall of the curve drilling assembly;

pumping drilling fluid through the drillstring and the drillstring orifice;

aligning the drillstring orifice and assembly orifice when the drillstring is in a defined rotational orientation with respect to the curve drilling assembly for causing a pressure decrease in the drilling fluid; and detecting the pressure signal.

7. A method of claim 6 utilizing a round drillstring orifice and an elongated slot assembly orifice.

8. A method of claim 6 wherein the pressure signal is generated by:

recording a pressure profile of the pumped drilling fluid when the drillstring is not rotating;

recording a pressure profile of the pumped drilling fluid when the drillstring is rotating; and comparing the pressure profiles.

9. A method of claim 5 wherein the plurality of reference signals are generated by:

establishing plurality of surface references having an initial orientation with respect to the defined rotational orientation of the drillstring relative to the curve drilling assembly;

providing a stationary detector for detecting the plurality of surface references; and detecting the plurality of surface references during each rotation of the drillstring.

10. A method of claim 5 including the step of determining torque distributed in the drillstring at about the time the pressure signal is generated.

11. A method of claim 10, wherein said step of determining torque is performed by using a strain gauge load cell.

12. A method of claim 5 wherein the pressure signal and the plurality of reference signals are compared by:

subtracting the signal delay time from the time at which the pressure signal was detected for determining the time at which orifices in the drillstring and curve drilling assembly were aligned;

analyzing the plurality of reference signals for determining the azimuthal orientation of the plurality of surface references at about the time at which orifices in the drillstring and curve drilling assembly were aligned;

using torque distributed in the drillstring for determining twist in the drillstring at about the time at which orifices in the drillstring and curve drilling assembly were aligned.

13. A method of dynamically monitoring the rotational orientation of a curve drilling assembly on a drillstring and reorienting the curve drilling assembly when necessary, the method comprising the steps:

(a) generating a pressure signal when a drillstring is in a defined orientation relative to a curve drilling assembly during drilling;

(b) generating a plurality of reference signals for monitoring the rotational orientation of the drillstring at which the pressure signal occurs;

(c) comparing the pressure signal and the plurality of reference signals for dynamically monitoring the rotational orientation of the curve drilling assembly; and (d) stopping drilling and reorienting the curve drilling assembly when dynamic monitoring indicates that reorientation is necessary.

14. A method of generating a correction factor accounting for sonic signal delay for use in determining the rotational orientation of a downhole tool on a rotatable conduit, comprising:

(a) rotating the conduit at at least two rotational speeds and generating a signal when the rotating conduit is in a defined rotational orientation with respect to the downhole tool;

(b) monitoring the rotational orientation of the rotating conduit at which each of the signals of step (a) occur; and (c) generating an indication of sonic signal delay for one or more rotational speeds from a calculation of linear slope of signals obtained from the at least two rotational speeds.

15. The method of claim 14, wherein the signal of step (a) is generated downhole; and wherein step (b) is performed above the surface of the wellbore.

* * * * *